US005938054A

United States Patent [19]

Loader

[11] Patent Number: 5,938,054

[45] Date of Patent: Aug. 17, 1999

[54] CHILD-RESISTANT CLOSURE ASSEMBLY

[75] Inventor: John Anthony Loader, Waterlooville, United Kingdom

[73] Assignee: Rexam Containers Limited, United Kingdom

[21] Appl. No.: 09/045,061

[22] Filed: Mar. 19, 1998

Related U.S. Application Data

[63] Continuation-in-part of application No. 08/599,720, Feb. 12, 1996, abandoned.

[30] Foreign Application Priority Data

Feb. 13, 1995 [GB] United Kingdom ..... 9502737

[51] Int. Cl.[6] ..... B65D 55/02

[52] U.S. Cl. ..... 215/206; 215/225; 215/254; 215/258

[58] Field of Search ..... 215/201, 206, 215/224, 225, 250, 254–256, 258, 317, 321, 337, 339, 340; 220/270, 276

[56] References Cited

U.S. PATENT DOCUMENTS

| | | |
|---|---|---|
| 4,071,156 | 1/1978 | Lowe . |
| 4,417,666 | 11/1983 | Roberts . |
| 4,449,639 | 5/1984 | Davis . |
| 4,511,051 | 4/1985 | Desai . |
| 4,524,876 | 6/1985 | Kusz . |
| 4,531,650 | 7/1985 | Friendship . |
| 4,573,599 | 3/1986 | Fillmore . |
| 4,790,448 | 12/1988 | Ostrum et al. . |
| 4,909,404 | 3/1990 | Rozenburg . |
| 4,919,286 | 4/1990 | Agbay, Sr. . |
| 5,207,783 | 5/1993 | Burton . |
| 5,292,019 | 3/1994 | Patterson . |
| 5,395,003 | 3/1995 | Matsuda . |
| 5,398,829 | 3/1995 | Stubbs . |
| 5,423,441 | 6/1995 | Conti . |

FOREIGN PATENT DOCUMENTS

| | | |
|---|---|---|
| 1489177 | 7/1967 | France . |
| 2064493 | 6/1981 | United Kingdom . |
| 2086361 | 5/1982 | United Kingdom . |
| 2255083 | 10/1992 | United Kingdom . |

*Primary Examiner*—Stephen K. Cronin
*Assistant Examiner*—Nathan Newhouse
*Attorney, Agent, or Firm*—Zackery, Furrer & Tezak

[57] ABSTRACT

The closure assembly of FIGS. 1 and 3 comprises a container 1, a cap 2 having a skirt portion 3, and a captive band 4 attached via a tamper-evident tear-off band 5 and a pair of frangible connections 6 and 7 to the skirt portion 3. Arrows 8 on the skirt 3 and 9 on the container 1 show that the cap 2 has been put on in the aligned position. A tab 10 on one end of the tear-off band 5 provides a grip for the fingers in removing the band. In FIG. 3 the tab 10 has been torn away to reveal a detent means on the container neck in the form of a projection 11. This is partly situated in a gap 19 under the tab 10 before this has been lifted away, and partly under the start end of the tear-off band 5, which is adapted to flex slightly to accommodate the projection 11 without any significant damage to the frangible connections 6 and 7. If an attempt is made to remove the cap 2 in the aligned position, before the frangible connections 6 and 7 have been torn, the lower surface 11*a* of the projection will be brought into abutment with an upwardly directed surface 4*a* of captive band 4, which constitutes a detent means on the captive band, so resisting removal of the cap.

20 Claims, 7 Drawing Sheets

CHILD-RESISTANT CLOSURE ASSEMBLY

CROSS-REFERENCE TO RELATED APPLICATION

This application is a continuation-in-part application of prior U.S. application, Ser. No. 08/599,720, filed Feb. 12, 1996, now abandoned, the benefit of the filing date of the prior application of which is hereby claimed under 35 U.S.C. § 120.

BACKGROUND OF THE INVENTION

This invention relates to child resistant closure assemblies comprising a co-operating container and cap in which anti-rotation means must be overcome to enable the cap to be rotated to a predetermined angular orientation on the neck of the container (this position being referred to herein as 'the aligned position') at which one side of the cap (referred to herein as the 'front of the cap') can be pushed off the neck in order to open the container.

In such closure assemblies the cap comprises a top wall and a depending skirt, and a co-operating circumferential bead and a lug are provided which engage to prevent the container from being opened, except at the aligned position. At the aligned position the lug, which is on the inside of the skirt at the front of the cap or on the neck of the bottle, can pass through a gap in the circumferential bead which is located on the neck of the container or inside the skirt at the front of the cap, so enabling the front of the cap to be pushed off the neck of the container in order to open the container.

Closure assemblies as described above are referred to herein as closure assemblies of the kind described.

In closure assemblies of the kind described, further engageable means are typically provided on the opposite side of the cap ('the rear of the cap') which disengage from the container neck on opening, so enabling the cap to be completely removed from the container. However, said further engageable means could be replaced, for example, with hinge means which attach the cap permanently to the container.

The present invention relates particularly, but not exclusively, to a closure assembly of the kind described which is the subject of a European patent application, having the same inventor as the present application, and published as EP 0500265. In this closure assembly, the further engageable means are provided on the rear of the cap and which disengage from the container neck on opening, to enable the cap to be completely removed from the container, and the skirt of the cap is connected by a number of breakable webs to a circumferentially extending tear-off band which in its turn is joined by further breakable webs to a continuous circumferentially extending captive band on the neck of the container. Lugs on the captive band and on the neck of the container engage to provide the anti-rotation means of the closure assembly. In this closure assembly the anti-rotation means prevent the cap from being rotated to the aligned position until the captive band has been disconnected from the cap by removal of the tear-off band, and removal of the band is tamper-evident.

Provision of the anti-rotation means in closure assemblies of the kind described is an additional child-resistant safety feature to that of arranging for the cap to be removable only in the aligned position.

However, these child-resistant safety features may be compromised in random instances of capping in the factory, if it is possible for the cap to be put onto the container already in the aligned condition, since it could then be possible for a child to remove the cap without difficulty.

Moreover, where there is a tear-off band, it may be possible to replace the cap without damaging the tear-off band, thereby overcoming the tamper-evidence normally provided by such a band.

In the closure assembly which is disclosed in the previously-referenced European patent application, published as EP 0500265, there is still some significant child-resistance in instances of capping in the aligned position, since, until the tear-off band has been removed, the tear-off band and the captive band make the cap less flexible, and add to the depth of the skirt, so making it difficult to push up the front of the cap to open the container.

Nevertheless, development work has been undertaken to increase the child resistance of the closure assembly should capping occur in the aligned position, and to promote tamper-evidence in such a situation. The present invention arises from this development work.

According to the present invention, a child-resistant closure assembly of the kind described is provided with separable means attached to the cap of the assembly by way of a frangible connection, the assembly comprising detent means on the separable means and on the neck of the container of the assembly, surfaces of the detent means being engageable in the cap aligned position to resist the cap being pushed off the neck of the container until the frangible connection has been broken, said surfaces being engageable in the cap aligned position.

Preferably breaking of the frangible connection is arranged to be tamper-evident. It may, for example, involve the removal of a tear-off band, the absence of which would be clearly visible.

Said separable means may itself comprise such a tear-off band, but most preferably comprises a band such as a captive band which is spaced from the cap by a tear-off band.

The detent means on the separable means preferably comprises a surface of the separable means.

The detent means on the neck of the container conveniently comprises a projection. Most preferably a surface of the projection is obliquely angled relative to the direction of capping of the container, in order to facilitate passage of the separable means over the projection without damaging the frangible connection of the separable means. In a preferred embodiment of the invention the detent means on the neck of the container comprises a projection in the form of a rib, extending partially around the container neck. The rib preferably extends around the neck through less than a quarter of the neck circumference. The detent means on the neck may comprise a plurality of projections disposed around the neck. Where the neck of the container is injection molded, the detent means on the neck is preferably provided on a circumferential bead on the neck.

Where the cap is provided with a tear-off band, the detent means on the neck of the container is desirably located in a gap between the ends of the tear-off band when capping has occurred in the aligned position. Where the detent means on the neck is disposed underneath a portion of a tear-off band, the tear-off band is preferably arranged to deform over the detent means without damaging its connection or connections to other parts of the closure assembly.

BRIEF DESCRIPTION OF THE DRAWINGS

By way of example only, specific embodiments of the invention applied to the closure assembly which is the subject of the previously referenced European patent application, published as EP 0500265, will now be described with reference to the accompanying drawings in which.

In the figures, like reference numerals refer to like features and components.

DETAILED DESCRIPTION OF THE PREFERRED EMBODIMENTS

Figure 1:
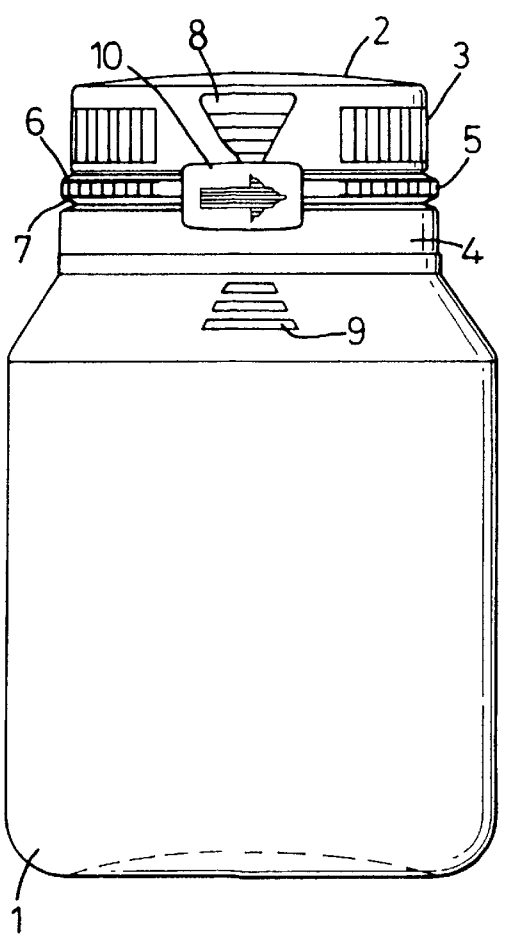
FIG. 1 is a front view of such a closure assembly according to the present invention in which the cap has been put on in the aligned position.
Figure 14:
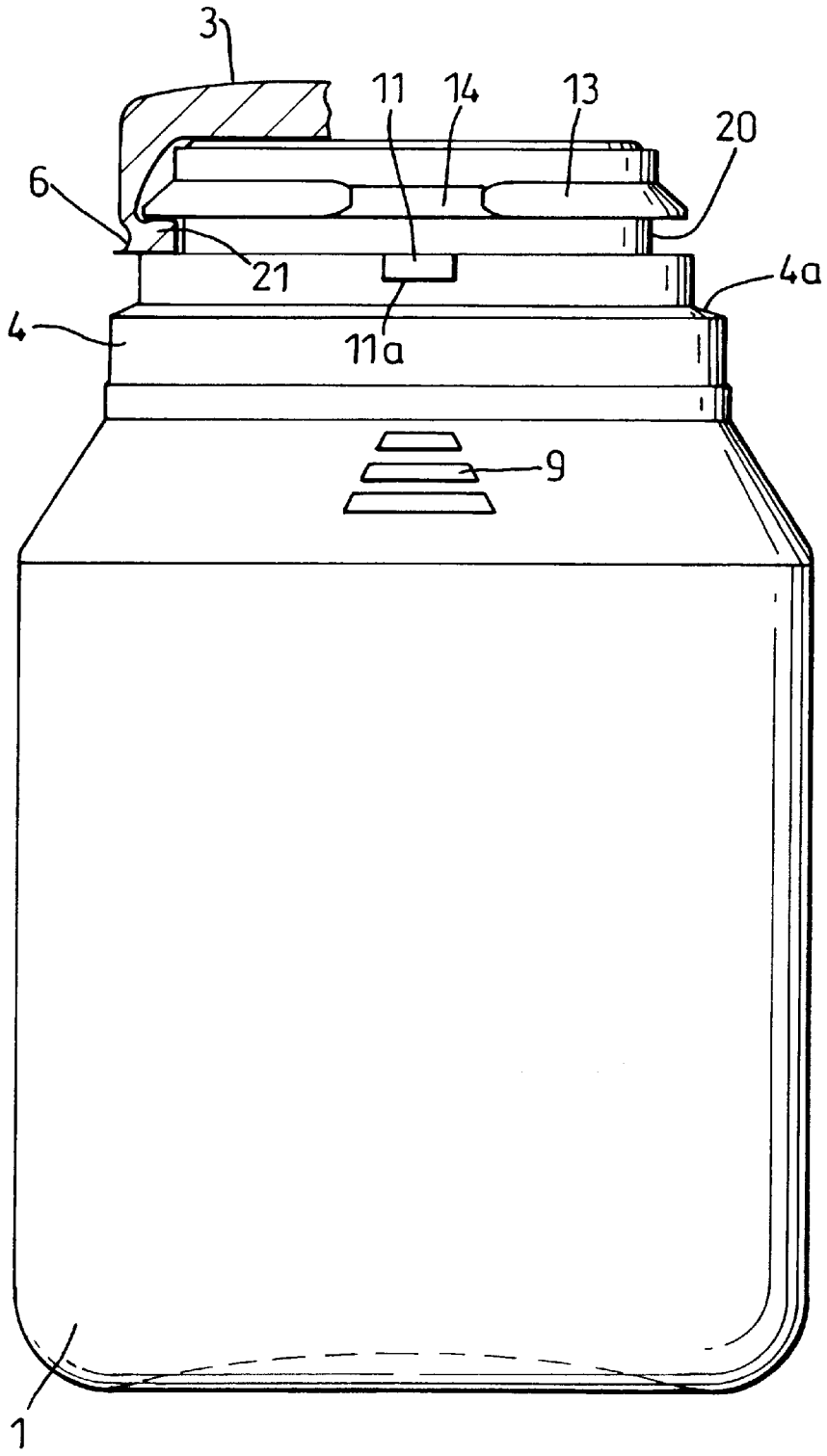
FIG. 14 is an enlarged figure identical to FIG. 3, but with a portion, in section, of the container cap added.

The closure assembly of FIG. 1 comprises an injection-molded container 1, a cap 2 having a skirt portion 3, and a captive band 4 attached via a tamper-evident tear-off band 5 and a pair of frangible connections 6 and 7 to the skirt portion 3. Arrows 8 on the skirt 3 and 9 on the container 1 show that the cap has been put on in the aligned position. The container 1, which includes a neck 20 (see FIG. 14) having an opening, may be blow-molded, at least in part.

A tab 10 on one end of the tear-off band 5 provides a grip for the fingers in removing the band.

Figure 2:
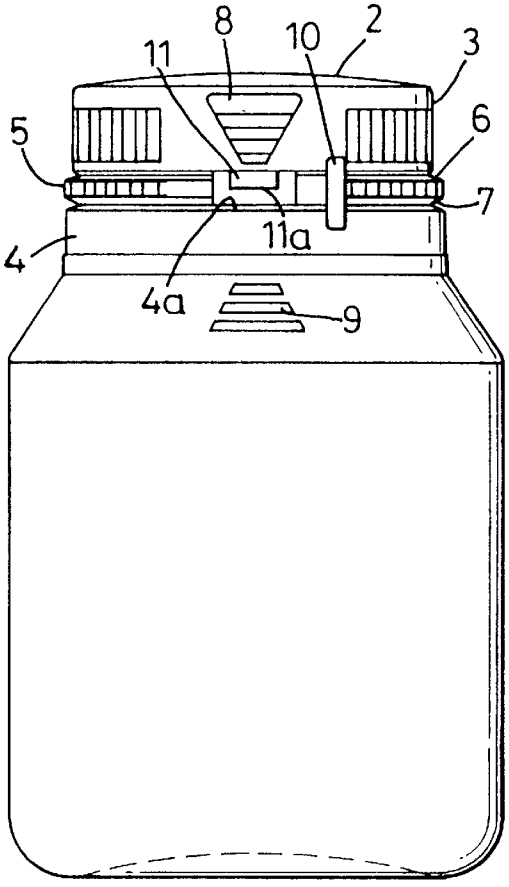
FIG. 2 is a front view of the closure assembly of FIG. 1 in which the start of the tear-off band has been lifted to reveal detent means in the form of a projection on the container neck.
Figure 16:
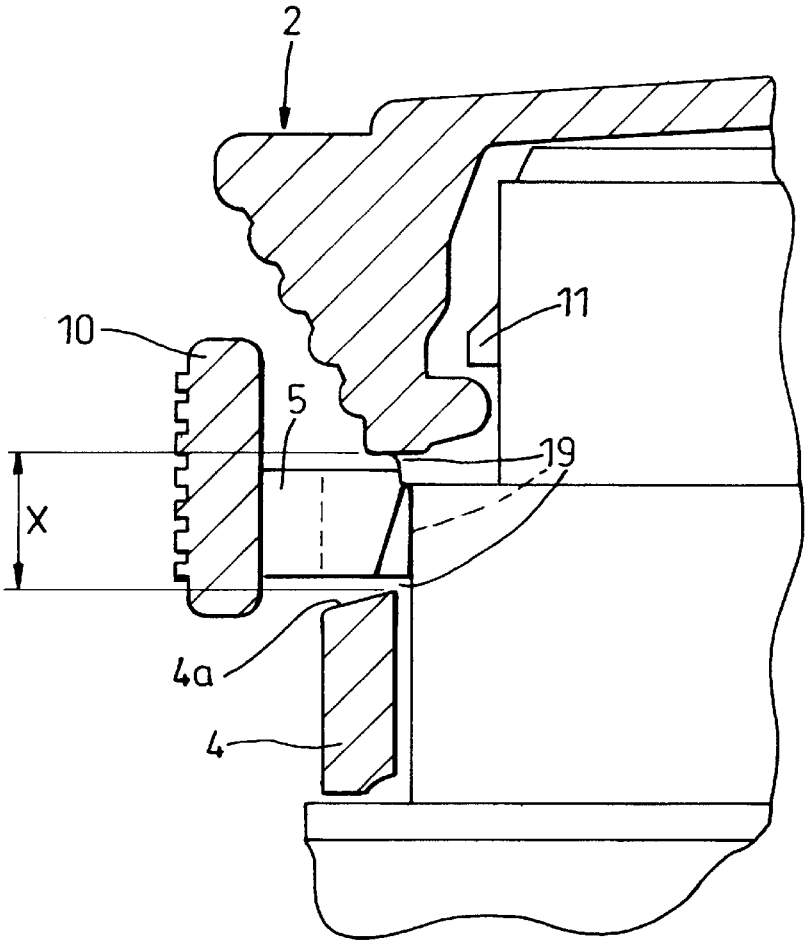
FIG. 16 illustrates a sectional view looking into a container cap.
Figure 17:
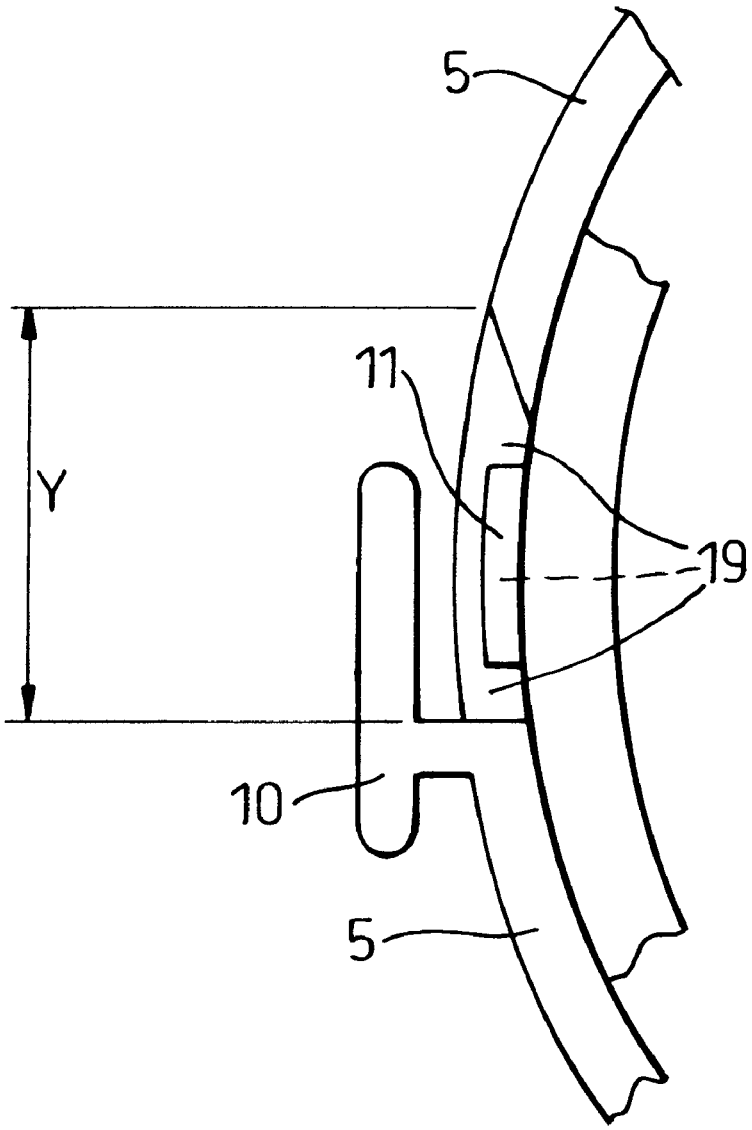
FIG. 17 is a sectional view taken on the line A—A of FIG. 2.

In FIG. 2 the tab 10 has been lifted away from the surface of the container neck 20 and partly torn away to reveal a detent means on the container neck in form of a projection 11. This is partly situated in a gap 19 under the tab 10 before this has been lifted away, between the ends of the tear-off band 5, and partly under the start end of the line tear-off band 5, which is adapted to flex slightly to accommodate the projection 11 without any significant damage to the frangible connections 6 and 7. FIG. 16 illustrates a sectional view in the aligned, ie non-child resistant position of the cap 2, looking into interior of the cap 2, such that the gap 19 is visible under the tab 10 and band 5. FIG. 17 is a fragmentary view, in section, taken on the line A—A of FIG. 2, but with the tab 10 in its original, ie unlifted position, and shows the gap 19 from above, as well as the projection 11.

In this example, the projection 11 comprises a rib which extends only partially around the neck of the container 1, preferably through less than a quarter of the neck circumference. In a random instance of factory-capping, the cap 2 could be placed on the container 1 in the aligned position. In such instances, the projection 11 advantageously resists removal of the cap 2, unless the tear-off band 5 has been removed. If an, attempt is made to remove the cap in the aligned position, before the frangible connections 6 and 7 have been torn, the lower surface 11*a* of the projection 11 will be brought into abutment with an upwardly directed surface 4*a* of captive band 4, which constitutes a detent means on the captive band, so resisting removal of the cap.

Figure 8:
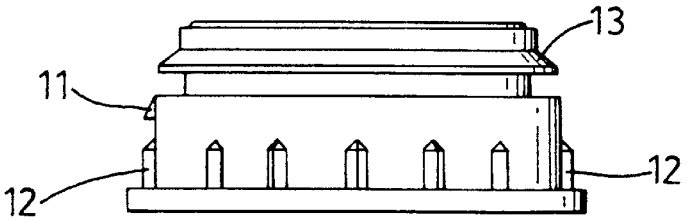
FIG. 8 is a side view of the neck of the container shown in FIG. 4 according to a second embodiment of the invention.

As described above, the cap 2 includes a gap 19 between the ends of the of tear-off band 5 (see FIGS. 16 and 17). The gap 19 provides room for the projection 11 to extend outward, which preferably extends at least partially therein, beyond the periphery of a circumferential bead 13 around the container neck (see FIGS. 6 and 8). The gap 19 thus permits the projection 11 to extend across the upper surface 4*a* of the captive band 4, so as to abut therewith if an attempt is made to remove the cap 2 in the aligned position before breakage of the frangible connections 6 and 7. The depth and breadth of the gap 19 are indicated by dimensions X and Y on FIGS. 16 and 17 respectively. The projection 11 also extends at least partially under the start of the tear-off band 5, and its tab 10, the band being adapted to flex slightly to accommodate the projection 11 without any significant damage to the frangible connections 6 and 7. This structure thus adds to the child resistance of the closure assembly.

The projection 11 also offers resistance when the cap 2 is non-aligned.

As previously described, the rib comprising the projection 11 extends around the container neck through preferably less than a quarter of the neck circumference. The limited circumferential extension of the projection 11 provides an advantage in a machine-capping process. In a machine-capping process, it is possible a frangible connection 6 and/or 7 could be perforated by contact with the projection 11. However, should this happen, the perforation will not be too serious as any perforation would be discrete due to the limited circumferential extension of the projection 11, thereby indicating the interior of the container 1 had not been violated. Such structure therefore reduces waste due to rejected product in a factory process.

Figure 3:
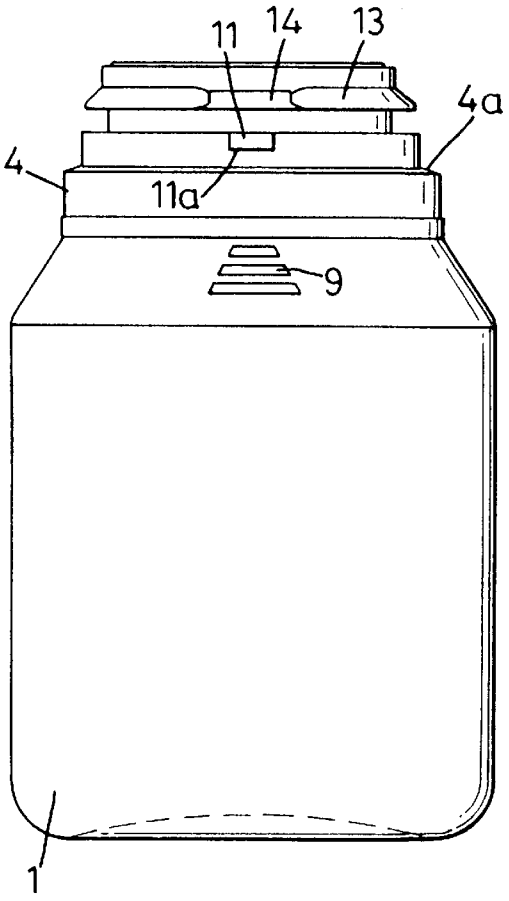
FIG. 3 is a front view of the container assembly of FIG. 1 in which the cap and the tear-off band have been removed, leaving behind a captive band on the neck.

FIG. 3 shows the closure assembly after the tear-off band 5 has been torn away and the cap removed, leaving the captive band 4 on the neck. A lug 21, (see FIG. 14), on the cap normally engages beneath circumferential bead 13 on the container neck to prevent removal of the cap, except in the aligned position in which the lug can pass through the gap 14 in the bead. The term 'captive band' is normally used to refer to a band which passes continuously around the neck of a container, but which is left behind after removal of a tear-off band. In this instance, after having been left behind, the captive band has no further role, and is free to fall off the neck of the container should the container be inverted.

Figure 4:
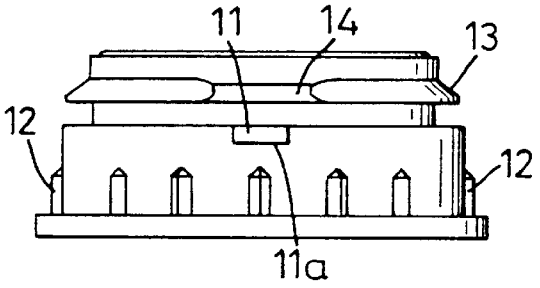
FIG. 4 is a front view of part of the container of FIG. 1, showing the neck finish of the container.
Figure 15:
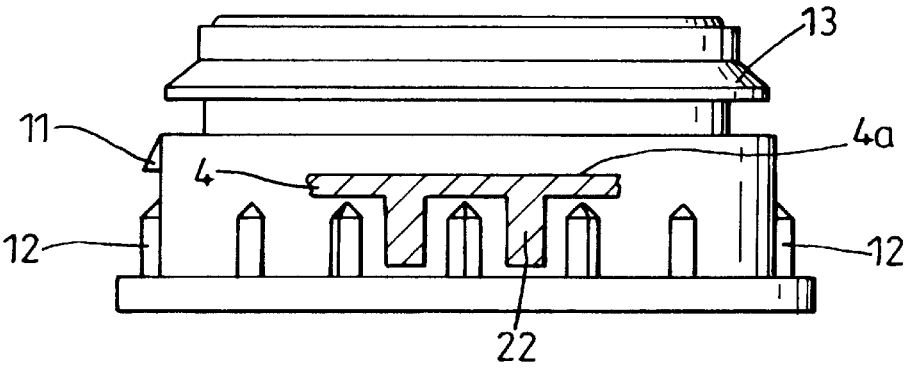
FIG. 15 is an enlarged figure identical to FIG. 8, but with a portion, in section, of the captive band added.

FIG. 4 shows the neck finish when the captive band has also been removed. Lugs 12 on the neck, which are normally covered by the captive band, interengage with lugs 22, (see FIG. 15), on the inside surface of the captive band to form the anti-rotation means of the closure assembly.

Figure 6:
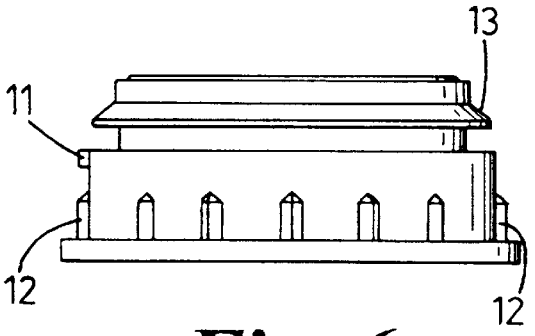
FIG. 6 is a side view of the neck of the container shown in FIG. 4 according to a first embodiment of the invention.
Figure 5:
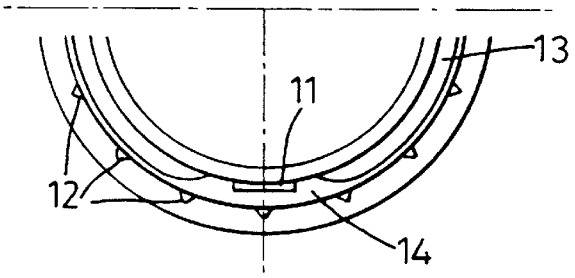
FIG. 5 is a partial plan view of the container, of FIG. 1 showing the neck finish of the container.
Figure 7:
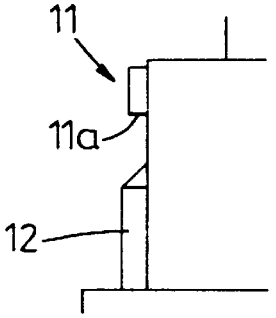
FIG. 7 is an enlargement of part of the FIG. 6.
Figure 9:
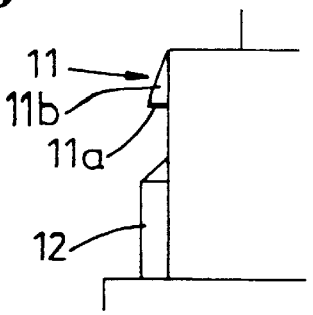
FIG. 9 is an enlargement of part of FIG. 8.

As can be seen from FIGS. 5 to 7, the projection 11 in one embodiment has sides which are substantially rectangular. However, in a second embodiment, shown in FIGS. 8 and 9, the projection is substantially wedge-shaped in vertical cross section, so as to present an obliquely angled surface 11*b* to the tear-off band 5 and the captive band 4 during capping, so that these can pass easily over the projection without damaging the frangible connections 6 and 7.

Figure 10:
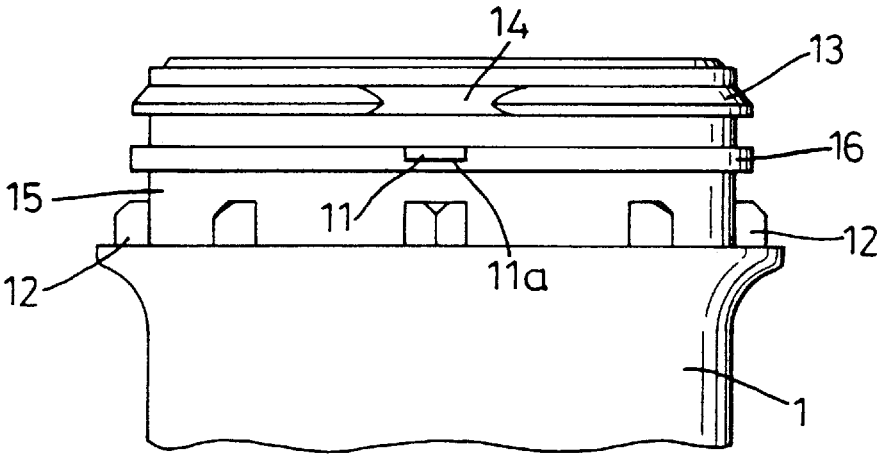
FIG. 10 is a front view of part of the container according to a third embodiment of the invention, showing the container with an injection-molded neck finish.
Figure 11:
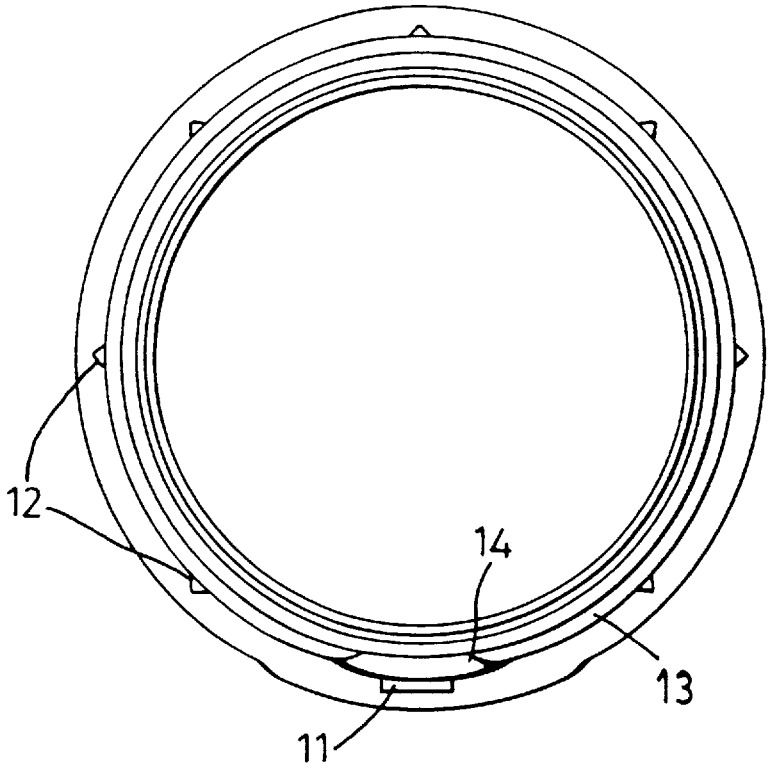
FIG. 11 is a plan view of the neck finish of FIG. 10.

In the embodiment of FIGS. 10 and 11, like reference numerals refer to similar parts to those of the embodiments of FIGS. 1 to 9. Since the container in this embodiment is injection molded, the lower portion of the neck finish has a surface 15 of reduced diameter in proportion to that of the lower portion of the neck finish of the embodiments of FIGS. 1 to 9, to limit material mass and thereby improve the speed of molding. However a land 16 is left in the form of a circumferential bead, which protrudes from surface 15 to a diameter where it lies closely adjacent to the inside surface of a tear-off band and corresponding in function to tear-off band 5 of the other embodiments. The projection 11 in this embodiment is provided on land 16.

Figure 12:
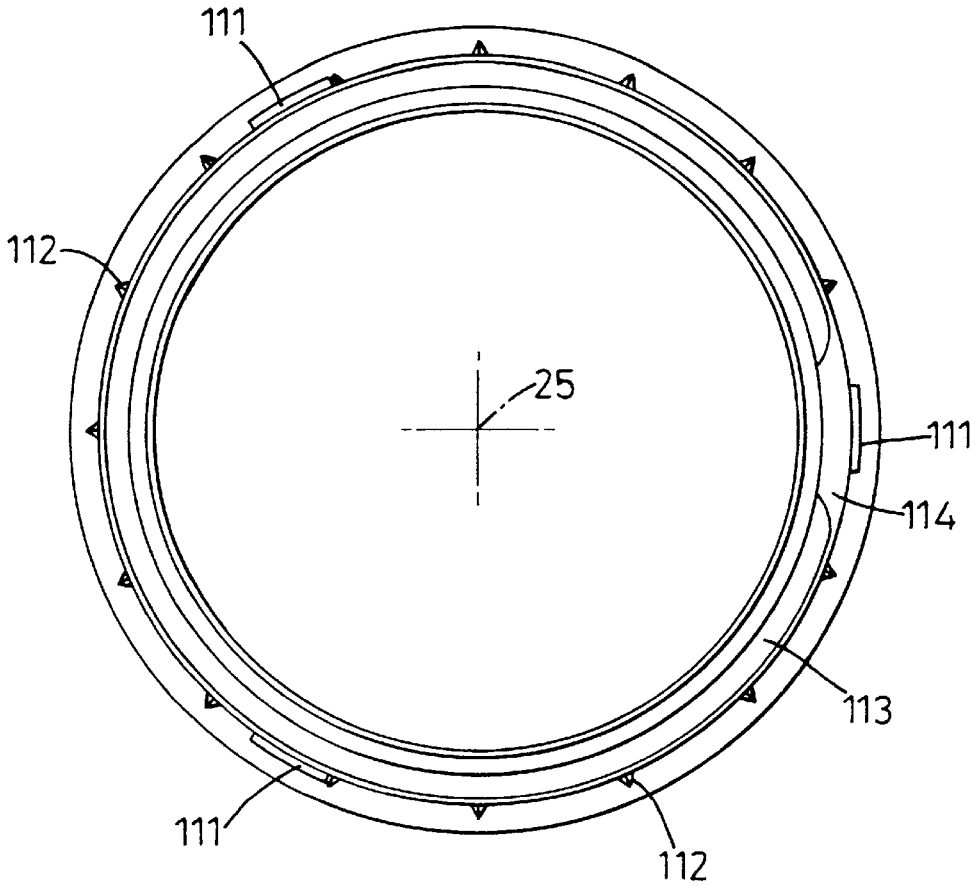
FIG. 12 is a plan view of a modified closure assembly in which the cap, tear-off band, and captive band have been removed.
Figure 13:
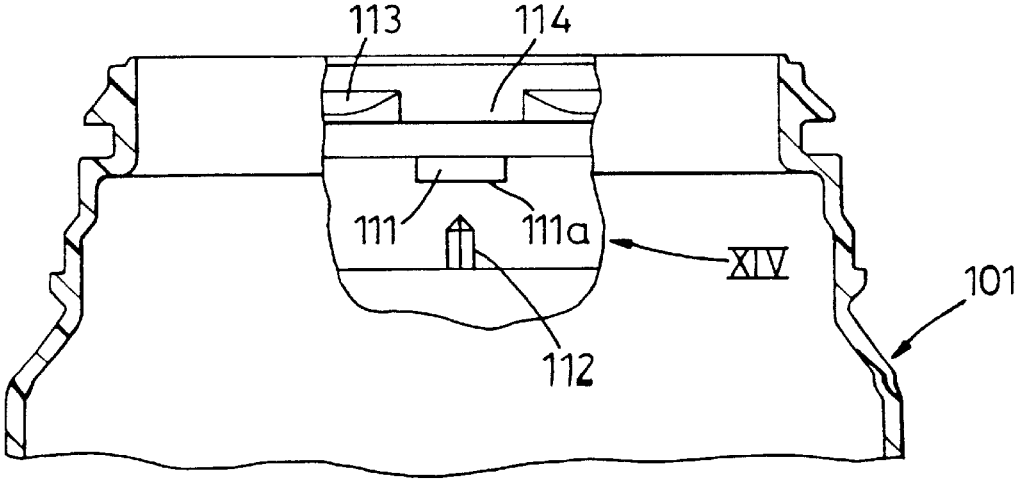
FIG. 13 is a fragmentary side view in section and showing, in area XIV, a fragmentary front view of the assembly container.

In FIGS. 12 and 13 a container 101 of an injection-molded closure assembly is illustrated thereby, the container cap, tear-off band and captive band having been removed for reasons of clarity. Like the container 1 of FIGS. 1 to 11, the container 101 may be blow-molded, at least in part.

The container 101 is provided with detent means on the neck of the container, comprising three equi-spaced projections 111 disposed in a ring which is coaxial about the central longitudinal axis 25 of the container. A single gap 114 is provided in the circumferential bead 113. One of the projections 11 is aligned with the gap 114 when capping takes place.

The non-illustrated container cap, the tear-off band and the captive band of the assembly are of substantially the same form as cap 2, tear-off band 5 and captive band 4 of FIGS. 1 and 2.

The provision of the plurality of lugs 111, spaced apart around the neck of the container 101 are for three reasons. Firstly, the lugs 111 serve to prevent the captive band (not shown, but corresponding to captive band 4 of FIG. 1) from falling off if the container, when opened, is inverted. Secondly, the plurality of spaced-apart lugs 111 serve to increase resistance to the container cap (not shown, but corresponding to cap 2 of FIG. 1) being removed, particularly in the cap aligned position, when the tear-off band is present.

Increased, that is, compared to the resistance provided by a single lug 11 of FIGS. 2 and 3. A single lug 11 offers resistance at a single, localized position, whereas the lugs 111 each offer substantially the same resistance, but at a number of spaced-apart positions.

Thirdly, the spaced-apart lugs 111 assist machine-capping, as the cap is centralized as it sits on the three lugs 111, before being pushed down into place.

Use of a single lug 11 can result in the associated cap assuming a tilted position before being pushed down into place, which is undesirable.

Where possible, any of the features disclosed herein may be added to, or substituted for other features. For example, the single lug 11 of FIGS. 10 and 11 could be replaced by a plurality of lugs, as in FIG. 12.

Other modifications are possible. For example, containers of increased neck size may employ more than three lugs corresponding to lugs 111. Furthermore, lug dimensions, particularly width, may vary according to requirements. Lugs, however, should be spaced widely around the container neck, and be of limited circumferential extension around the neck circumference. In a machine capping process, such lugs could contact frangible connects and cause perforation thereof. If the lugs, though, are widely spaced and of limited circumferential extension around the container neck, any perforations will be discrete, indicating no violation of the container interior. Such structure thus reduces waste due to rejected product in a factory process.

The embodiments of the invention in which an exclusive property or privilege is claimed are defined as follows.

I claim:

1. A child-resistant closure assembly comprising:

a container having a neck, with an opening to the container defined through the neck, a container closure cap co-operable with the neck of the container, closing the container, said cap having an internal lug projecting towards the container neck, a captive band embracing the container neck, a tear-off band also embracing the container neck and disposed between the captive band and the cap, a first frangible connection joining the cap to the tear-off band, a second frangible connection joining the tear-off band to the captive band, an annular bead projecting from the container neck, said internal lug of said cap being disposed beneath the annular bead so as to be engageable with the undersurface thereof, the annular bead defining a gap for through passage of said internal lug of the cap when the lug and gap are in alignment, an outwardly-extending projection carried by the container neck, the outwardly-extending projection extending around the container neck through less than a quarter of the circumference of the neck, and co-operable, by engagement with the captive band so as to resist removal of the cap from the container neck until the tear-off band has first been removed by breakage of the first and second frangible connections, and first and second inter-engaging lugs on, respectively, the inside surface of the captive band and the outside surface of the container neck, which co-operate to prevent relative rotation of the cap and the container, until removal of the tear-off band.

2. A closure assembly as claimed in claim 1, wherein the outwardly-extending projection defines a downwardly and outwardly-extending outer surface.

3. A closure assembly as claimed in claim 1, wherein the outwardly-extending projection defines a flat undersurface which co-operates by abutment with the upper surface of the captive band to resist removal of the cap from the container neck.

4. A closure assembly as claimed in claim 1, provided with a plurality of said outwardly-extending projections, disposed in an equi-spaced array around the container neck.

5. A closure assembly as claimed in claim 1, wherein the gap defined by the annular bead is aligned with the outwardly-extending projection carried by the container neck.

6. A closure assembly as claimed in claim 1, wherein the container comprises a molding of plastics material.

7. A closure assembly as claimed in claim 1, wherein the outwardly-extending projection carried by the container neck comprises a rib.

8. A closure assembly as claimed in claim 1, further including another gap, this being defined in the tear-off band for extension of the outwardly-extending projection into said gap defined in the tear-off band.

9. A closure assembly as claimed in claim 8, wherein the tear-off band includes a first end and a second end, said ends opposing one another across a space, said space defining the gap in the tear-off band.

10. A child-resistant closure assembly comprising:

a container having a neck, with an opening to the container defined through the neck, a container closure cap co-operable with the neck of the container, closing the container, said cap having an internal lug projecting towards the container neck, a captive band embracing the container neck, a tear-off band also embracing the container neck and disposed between the captive band and the cap, a first frangible connection joining the cap to the tear-off band, a second frangible connection joining the tear-off band to the captive band, an annular bead projecting from the container neck, said internal lug of said cap being disposed beneath the annular bead so as to be engageable with the undersurface thereof, the annular bead defining a first gap for through passage of said internal lug of the cap when the lug and first gap are in alignment, an outwardly-extending projection carried by the container neck, the tear-off band defining a second gap for extension of the outwardly-extending projection therein, the outwardly-extending projection being co-operable, by engagement with the captive band so as to resist removal of the cap from the container neck until the tear-off band has first been removed by breakage of the first and second frangible connections, and first and second inter-engaging lugs on, respectively, the inside surface of the captive band and the outside surface of the container neck, which co-operate to prevent relative rotation of the cap and the container, until removal of the tear-off band.

11. A closure assembly as claimed in claim 10, wherein the outwardly-extending projection defines a downwardly and outwardly-extending outer surface.

12. A closure assembly as claimed in claim 10, wherein the outwardly-extending projection defines a flat undersurface which co-operates by abutment with the upper surface of the captive band to resist removal of the cap from the container neck.

13. A closure assembly as claimed in claim 10, provided with a plurality of said outwardly-extending projections, disposed in an equi-spaced array around the container neck.

14. A closure assembly as claimed in claim 10, wherein the first gap defined by the annular bead is aligned with the outwardly-extending projection carried by the container neck.

15. A closure assembly as claimed in claim 10, wherein the container comprises a molding of plastics material.

16. A closure assembly as claimed in claim 10, wherein the outwardly-extending projection carried by the container neck comprises a rib.

17. A closure assembly as claimed in claim 10, wherein the tear-off band includes a first end, and a second end, said ends opposing one another across a space, said space defining the second gap in the tear-off band.

18. A closure assembly as claimed in claim 10, wherein the outwardly-extending projection extends around the container neck through less than a quarter of the circumference of the neck.

19. A closure assembly as claimed in claim 18, provided with a plurality of said outwardly-extending projections, disposed in an equi-spaced array around the container neck.

20. A closure assembly as claimed in claim 18, wherein the first gap defined by the annular bead is aligned with the outwardly-extending projection carried by the container neck.

* * * * *